United States Patent [19]

Ray, III et al.

[11] 4,308,679

[45] Jan. 5, 1982

[54] LAMINATED CONTAINER STRUCTURE INCORPORATING A PEELABLE PANEL SECTION HAVING A HEAT TRANSFERABLE IMAGE

[75] Inventors: George C. Ray, III, Battle Creek; Michael J. Otto, Kalamazoo; Charles E. Price, Delton, all of Mich.

[73] Assignee: General Foods Corporation, White Plains, N.Y.

[21] Appl. No.: 219,008

[22] Filed: Dec. 22, 1980

Related U.S. Application Data

[63] Continuation of Ser. No. 2,701, Jan. 10, 1979.

[51] Int. Cl.[3] ..... G09F 3/00

[52] U.S. Cl. ..... 40/312; 40/2 R

[58] Field of Search ..... 40/312, 306, 310; 428/914; 206/459; 283/18, 21; 229/16 R

[56] References Cited

U.S. PATENT DOCUMENTS

| | | | |
|---|---|---|---|
| 1,004,055 | 9/1911 | Martin et al. | 283/21 |
| 2,167,637 | 1/1963 | Claff | 40/312 |
| 3,071,882 | 1/1963 | Eisman et al. | 40/312 |
| 3,110,121 | 11/1963 | Corrinet | 40/312 |
| 3,315,386 | 4/1967 | Kest et al. | 40/2 R |
| 3,638,340 | 2/1972 | Gottschalk | 428/914 |
| 3,959,555 | 5/1976 | Day et al. | 428/914 |
| 3,989,609 | 11/1976 | Brack | 428/914 |

*Primary Examiner*—Gene Mancene
*Assistant Examiner*—Wenceslao J. Contreras
*Attorney, Agent, or Firm*—C. Garmen Hubbard; Thomas V. Sullivan; Daniel J. Donovan

[57] ABSTRACT

A laminated or multiple-ply container structure comprising an inner wall of a substantially rigid material and an outer wall of a thin, generally pliant material, such as a glossy finished paper, adhesively fastened thereto by a suitable adhesive or glue. Formed in the outer wall of the container, as an integral component thereof, and through the intermediary of a tear outline constituted of perforations extending through at least the outer ply or wall is a section constituting a readily removable or peelable coupon-like panel, with the peeling off of the panel adapted to be effectuated without adversely affecting the integrity of the container structure or necessitating the use of special cutting instruments or tools. The outer surface of the removable panel has a heat transferable image imprinted thereon which, after separation of the panel from the container structure, is adapted to be positioned in contact with a suitable transfer surface whereby, through the application of a hot iron, the transferable image which is also commonly referred to as an "iron-on" is imparted to the transfer surface to form a decorative image or imprint thereon.

11 Claims, 3 Drawing Figures

LAMINATED CONTAINER STRUCTURE INCORPORATING A PEELABLE PANEL SECTION HAVING A HEAT TRANSFERABLE IMAGE

This is a continuation of application Ser. No. 002,701, filed Jan. 10, 1979.

BACKGROUND OF THE INVENTION

The present invention relates to a laminated container structure and, more particularly, to a container or package having a heat transferable image or iron-on as a readily detachable portion or section of an outer ply or wall thereof, preferably in the form of an easily removable panel.

The merchandising of commodities which are packaged in packaging media such as closed containers, currently employs the widespread practice of including a redeemable coupon, mailing card, ticket or premium within the container. Among such premiums or promotional items are also the popular iron-ons or heat transferable images which may be applied in a decorative manner to a suitable garment, such as a T-shirt, blouse or the like. The foregoing is subject to the limitation that the purchaser cannot redeem the coupon or employ the promotional item until the package is opened so as to provide access to the commodity and coupon, premium or iron-on contained therein. Alternatively, the iron-on or heat transferable image may be affixed to the exterior surface of the container, such as in the form of a decal, adapted for easy detachment thereof by a purchaser or consumer. However, this type of structure frequently entails the inadvertent loss of the iron-on or heat transferable image during storage, shipping or handling of the container, or may even be conducive to the deliberate removal and theft of the iron-on preceding the sale of the container. The heat transferable image may also be printed on the exterior surface of the container or package, and may be cut out by the consumer after the container is opened. This, however, will destroy the integrity of the carton and prevent the merchandise contained therein from being stored for any appreciable length of time. Consequently, a printed-on promotional item of this type is only practicable when the merchandise has been used and the container is in an emptied condition. Moreover, removal of this type of iron-on or decal necessitates the employment by the consumer, who may be a child, of a sharp cutting object, such as scissors or a knife; a frequently dangerous practice which conceivably may cause serious injuries.

2. Discussion of the Prior Art

More recently, containers or packages have been developed which incorporate easily detachable or peelable coupons or decals as integral elements of the outer wall or ply of the container structure, with such elements readily being adaptable for use as promotional items or premiums.

Thus, Loderhose U.S. Pat. No. 24,962 discloses a phonograph record jacket having a detachable or peelable picture-bearing coupon incorporated in the outer ply of the jacket for separation thereof along a predetermined perforated tear outline. In this construction the removal of the coupon, or pictorial portion, will leave a loose and readily tearable peripheral edge in one exterior surface of the jacket, thereby rendering the latter easily torn and unsightly when repeatedly handled for any significant period of time.

Krug U.S. Pat. No. 2,420,045 relates to a coupon which is an element in the outer wall or ply of a container, adapted to be readily separated along perforated tear lines. However, in this instance, the coupon is an appendage of the outer ply of the container, which is then folded over to provide a double-thickness wall portion suitable for peeling off by an ultimate purchaser or consumer of the container. This structure requires the utilization of extra lengths of outer container material, while concurrently permitting the coupon to be inadvertently or deliberately detached from the container prior to the sale of the latter.

Corrinet U.S. Pat. No. 3,110,121 and Gorman et al U.S. Pat. No. 3,463,303 each describe containers providing for detachable coupons as integral components of the outer ply of a container wall structure. However, neither of these patents contemplate the coupon being an integral portion entirely contained within one surface of the outer ply or wall structure of the container, and require the destruction of the end of the wall portion, thus creating the risk of inadvertently affecting the integrity of the container, or possibly producing an uneven or jagged container end edge after removal of the coupon.

Furthermore, there is also presently pending U.S. Patent application Ser. No. 836,873, filed Sept. 26, 1977, which discloses a multiple-ply container structure wherein a peelable coupon forms an integral portion of the outer container wall and is defined by a perforated tear outline. An adhesive-repellent medium is coated to the inner surface of the outer wall below the coupon-defining area to prevent adherence of the coupon to the adhesive fastening together the outer and inner walls of the container.

However, none of the above-mentioned patents and patent application disclose, nor suggest, incorporating as a promotional feature, an integral component in the outer wall of a multiple-ply container structure, of a readily detachable or peelable panel defined by a predetermined tear outline, and which includes a heat transferable image or iron-on imprinted on the outer surface of the panel.

SUMMARY OF THE INVENTION

Accordingly, the present invention contemplates the provision of a laminated or multiple-ply container structure comprising an inner wall of a substantially rigid material and an outer wall of a thin, generally pliant material, such as glossy finished paper, adhesively fastened thereto by means of a suitable adhesive or glue. Formed in the outer wall of the container, as an integral component thereof, and through the intermediary of a tear outline constituted of perforations extending through at least the outer ply or wall is a section constituting a readily removable or peelable coupon-like panel, with the peeling off of the panel adapted to be effectuated without adversely affecting the integrity of the container structure or necessitating the use of special cutting instruments or tools. The outer surface of the removable panel has a heat transferable image imprinted thereon which, after separation of the panel from the container structure, is adapted to be positioned in contact with a suitable transfer surface, for instance, a T-shirt, blouse or other garment. Thereafter, through the application of a hot iron, the transferable image which is also commonly referred to as an "iron-on" is imparted to the transfer surface to form a decorative image or imprint thereon.

In a preferred embodiment of the invention, the interior surface of the outer container wall, in effect, the surface of the outer ply which is in contact with the adhesive material bonding the outer wall to the inner wall of the laminated container is provided with a coating of a release agent or adhesive-repellent medium over a predetermined patterned area which is substantially coextensive with the area defined by the detachable panel having the heat transferable image imprinted thereon, in effect, within the region bounded by the perforated tear outline. The provision of this coating on the back or inner surface portion of the outer wall constituting the panel or so-called "iron-on" will facilitate the easy peeling off of the panel by the purchaser or consumer of the packaging medium or container, and allows for the detached panel to be applied to a transfer surface for the "ironing-on" of the heat transferable image thereon while concurrently fully maintaining the integrity of the container and its contents.

Pursuant to the invention, the heat transferable image or "iron-on" which is imprinted on the detachable or peelable panel preferably is constituted of a heat transferable substance consisting of sublimation dyes, disperse dyes, pigmented sublimation inks, or vinyl plastisol films. In order to impart scuff resistance to the dyes or inks during transport, storage and handling of the containers, the heat transferable image has a protective coating superimposed thereon, such coating, however, being permeable to the hot transfer of the inks or dyes onto a transfer surface or substrate. In addition, the tear outline has been designed to improve peelability of the removable panel by minimizing the risk of tears at the leading edge and undesired propagation of the peeling action beyond the trailing edge into the adjacent area of the outer wall material. This is accomplished by forming the perforations of the leading edge as discontinuous slits arranged in overlapping end to end relationship and by forming the trailing edge with one continuous slit, the latter feature calling for adhesion between the removable outer wall panel and the inner wall along a narrow border area of the trailing edge in order to avoid ballooning of the panel during manufacture of the carton and subsequent handling thereof.

Accordingly, it is a primary object of the present invention to provide a laminated container structure of the type described hereinabove which incorporates a readily removable or peelable panel having a heat transferable image thereon as an integral component of the outer wall or ply of the multi-plied container structure.

Another object of the present invention is to provide a novel laminated container structure in which the removal of the panel which is integrally formed in the outer ply or wall of the container will not adversely affect the integrity of the container structure while permitting the panel to be applied to a transfer surface for the hot transfer of the heat transferable image or "iron-on" imprinted thereon.

Yet another object of the present invention is to provide a laminated carton structure of the type described in which the portion of the outer ply or wall constituting the "iron-on" bearing panel has surface area thereof facing the adhesive material intermediate the container plies coated with a release agent or adhesive-repellent medium so as to thereby permit the easy peeling off of the panel by a consumer without the necessity of employing any specialized tools or sharp cutting implements.

A still further object is to improve the design of the perforated tear outline so as to minimize tearing of the removable panel at its leading edge and extension of the peeling action beyond its trailing edge.

A more specific object of the present invention is to provide a laminated container structure of the type described, wherein the peelable panel which is incorporated in the outer ply or wall of the container as an integral portion thereof has imprinted thereon a decorative heat transferable image or so-called "iron-on" of a heat transferable substance consisting of sublimation dyes, disperse dyes, pigmented sublimation inks, or vinyl plastisol films.

BRIEF DESCRIPTION OF THE DRAWINGS

These and other objects of the present invention may be more readily understood by having reference to the following detailed description of a preferred embodiment of the inventive laminated container structure incorporating the peelable panel having the heat transferable image imprinted thereon, taken in conjunction with the accompanying drawings; in which.

DETAILED DESCRIPTION OF THE INVENTION

Figure 1:
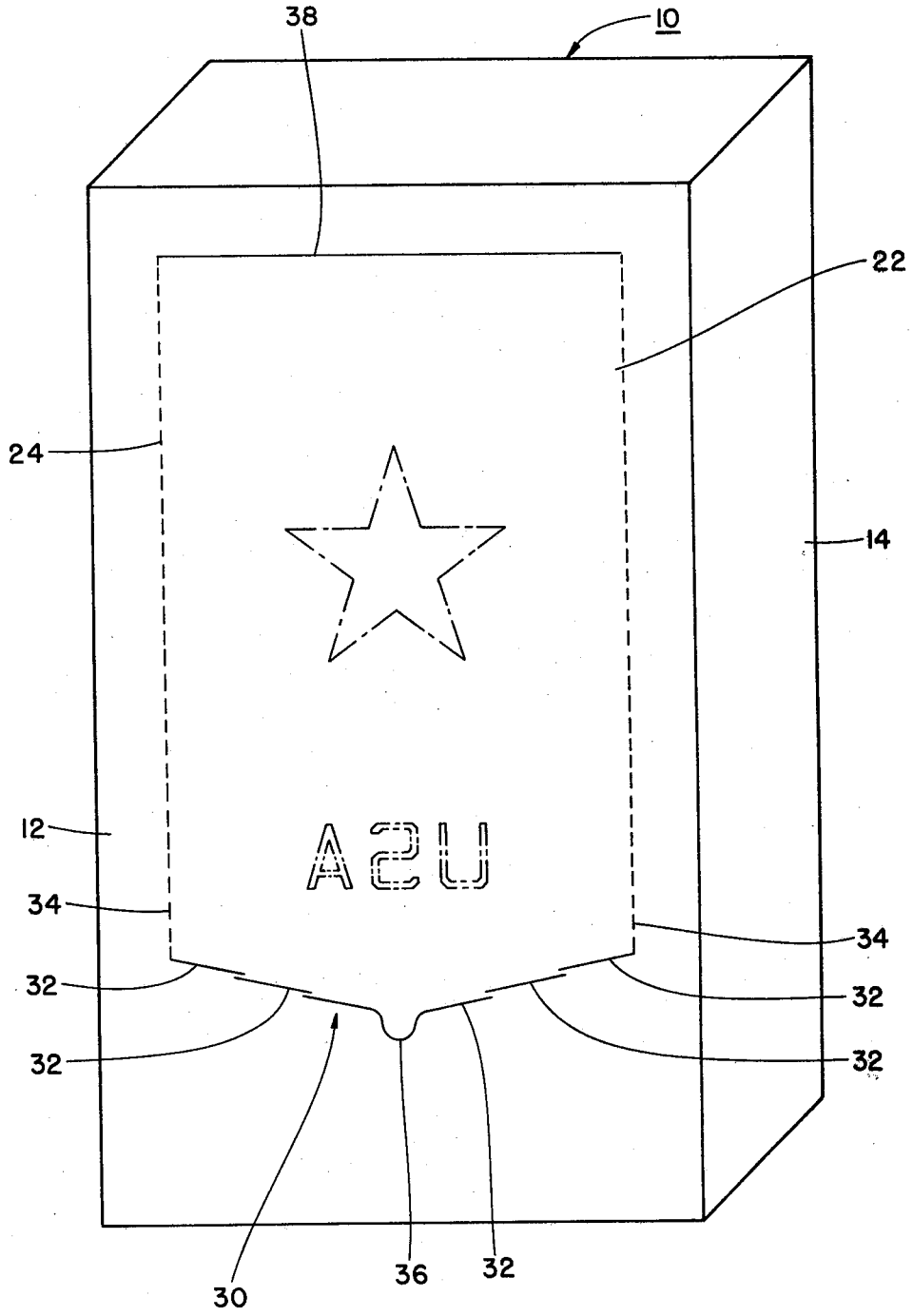
FIG. 1 shows a perspective view of a portion of a laminated container structure in conformance with the present invention.
Figure 2:
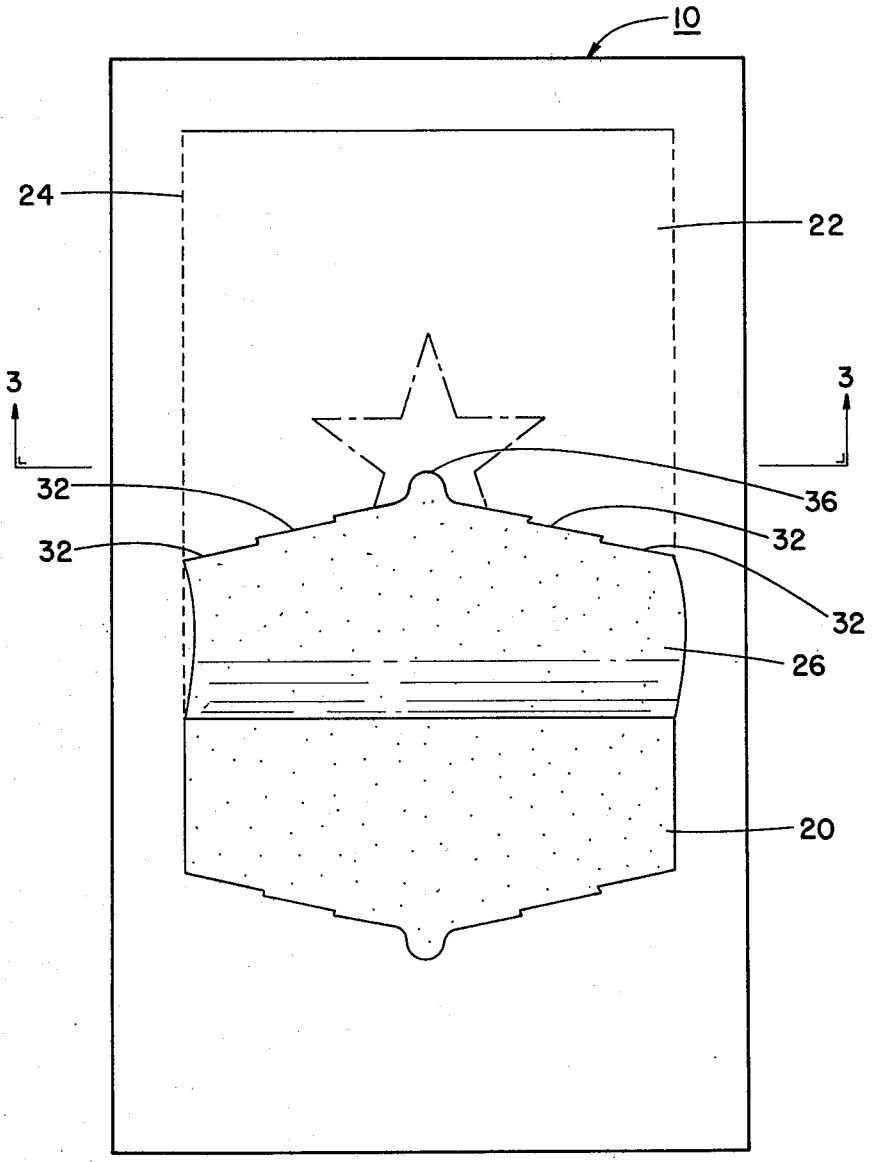
FIG. 2 is an elevational view of a portion of a container similar to that of FIG. 1 and illustrating a somewhat modified coupon structure.
Figure 3:
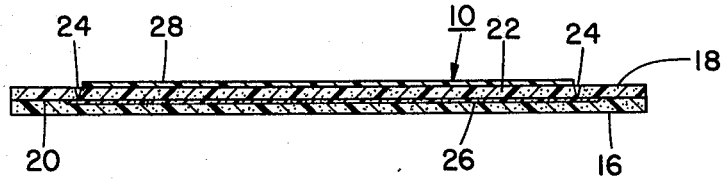
FIG. 3 is a sectional view, on an enlarged scale, taken along line 3—3 in FIG. 2.

Referring now in detail to the drawings, the embodiment of the invention illustrated in FIGS. 1 to 3 is directed to a merchandise package or container structure 10 which is basically constituted of rectangularly-sided carton for bulk goods or commodities such as, for example, dry cereal, cookies, condiments and other consumer oriented merchandise. Quite apparently, other shapes of containers such as, for example, cylindrical, pyramidal, conical or the like, are equally applicable to the invention. The container 10, as is well known in the art, is constructed of the usual front, rear and side panels 12 and 14, and suitable top and bottom closures (not shown).

Having particular reference to FIG. 3, as is well known in the packaging media art, the container 10 may be constituted of a laminated or multi-ply construction comprising an inner wall 16 formed of a generally rigid paperboard or cardboard material and an outer wall 18 formed of a thin pliant material, such as a glossy finished paper, adapted to have suitable indicia or legends imprinted or embossed thereon. The outer wall 18 is adhesively fastened to the inner wall 16 through the interposition of a layer or coating of an adhesive material or glue 20.

A peelable or detachable panel 22 is incorporated in the outer wall 18, as an integral portion of the latter, on one of the panels 12 or 14 of the carton 10 through the formation of a tear outline constituted of slits or perforations 24 extending through at least the outer wall 18.

In order to facilitate the peeling away or tearing off of the peelable panel 22 from the container 10 along the tear outline formed by the perforations 24, a suitable release agent or adhesive-repellent medium 26 may be coated on the rear surface of the peelable panel portion 22 of the outer wall 18, in effect, the surface which is in contact with the adhesive material 20, to thereby prevent any adhesion between the back of the panel portion 22 and the inner wall 16 of the container. Suitably, such release agent or adhesive-repellent medium may be constituted of a paraffin wax or microcrystalline wax which will not adhere to the adhesive material 20. The area of the surface of the outer wall 18 of the carton which is coated with the release agent 26 is substantially coextensive with the surface area of the peelable panel 22 confined within the tear outline of the perforations 24.

Since the application of the release agent or adhesive-repellent medium 26 is essentially restricted to the area of the rear surface of outer wall 18 which is confined within the perforation tear outline 24, as shown in FIG. 3, subsequent to the peeling away of the panel portion 22, the outer periphery of that area will have the perforated edges of outer wall 18 firmly adhered to the inner wall 16, forming a smooth tear edge and thereby preventing any inadvertent tearing and disfiguring of the remaining outer wall or ply of the container 10. Moreover, since the perforations 24 do not cut into the inner wall 16 to any appreciable extent, the strength and integrity of the carton 10 remains essentially unimpaired to allow for long-term storage and use by the consumer of the merchandise contained therein.

The heat transferable image on the peelable panel portion 22, which ultimately forms the "iron-on" is printed thereon by means of gravure or other acceptable and compatible printing methods. As desired, the heat transferable image can be printed onto the surface of the outer ply 18 concurrent with or subsequent to the printing of the carton graphics on the remaining surface of the outer carton surface. The laminating adhesive-repellent medium 26 is generally applied during the same printing process to the opposite side of the outer ply 18 within the area defined by the perforations 24 and by the registration tolerances of the manufacturing process for the container 10.

The heat transferable image which is printed on the outer ply 18 of the container 10 is usually composed of such heat transferable substances as sublimation or disperse dyes, pigmented sublimation inks, vinyl plastisol films or the like. Substances which would be applicable thereto in providing the heat transferable image are disclosed in U.S. Pat. Nos. 3,813,218 and 4,021,591, the disclosures of which are herein incorporated by reference.

A thin protective coating 28 is applied directly over the heat transferable image on the panel portion 22 so as to impart scuff resistance to the dyes, but which is permeable to their transfer during the iron-on application process. Additionally, the protective coating 28 and the resins in the sublimation inks forming the heat transferable image provide a temporary tack when applied to a transfer surface or substrate on a garment onto which the image is to be cut and transferred. This will effectively prevent slipping and blurring of the image during application. The protective coating and the resin in the sublimation inks do not transfer to the garment.

Referring to FIGS. 1 and 2 of the drawings, illustrated panel portion 22 which is detachable or peelable from the container 10 is of a generally rectangular configuration. In this embodiment, although not limited thereto, the wide leading edge 30 of the detachable iron-on or panel portion 22 is formed so as to be completely liftable from the carton 10 within a relatively short distance without inducing excessive stress and resultant tears in the outer ply 18. The leading edge 30 is formed of lengthy overlapping cuts 32, in this instance each approximately one inch long, which penetrate the outer ply 18. The cuts 32 originate from each side perforation 34 and, in the illustrated embodiment, deviate from the perpendicular to the side perforations by an outwardly extending angle of about 10° to 15° C. The cuts 32 meet towards the center of the leading edge 30 and join into a semicircular lift tab 36. The cuts 32 are separated from each other by a distance of approximately 1/16 to ⅛ inch and are overlapped so that, as the tab 36 is raised, its tear will originate in the outer ply 18 at the ends of one cut 32 and propagate in the direction of the pulling force until it meets the end of the adjacent overlap cut. As a result, the leading edge 30 of the iron-on or panel portion 22 is released from the container 10 by a series of stepped tears in which the tears "jump" from cut to cut at each overlap and are displaced laterally from the lift tab 36 until they join the side perforations 34. This method of perforation permits the removal of the iron-on from the container 10 to initiate from a single point and to spread in a direction transverse to that of the applied force. It is extremely important to eliminate tears which may occur at the leading edge 30 since they would tend to propagate in the direction of the applied force into the heat transferable image forming the iron-on.

The side perforations 34 which define the side boundaries of the panel portion 22 may be of a conventional size known in the art and are chosen for optimum severance of the specific material utilized in the outer ply 18.

The trailing edge 38 of the panel portion 22 is formed through the intermediary of a continuous cut which is desired so as to completely sever the outer ply 18 and which extends transversely between the side perforations 34. Preferably this cut 38 is positioned approximately ⅛ inch or any suitable small distance beyond the edge of the adhesive-repellent medium 26 so that the entire trailing edge 38 of the panel portion 22 is laminated to the inner ply 16 by a small or narrow strip of adhesive 20. This will assure that the trailing edge 38 will adhere adequately to the inner ply during the manufacturing process of the carton 10, while the continuous cut 38 prevents undesired outer ply material, along the opposite abutting edge, from being stripped from the container 10 as the panel portion 22 is peeled off. The mechanism of effecting the release of this adhered edge for the container 10 formed from the two plies 16, 18 of a fibrous material is of tensile failure within the material of the outer ply 18. In effect some of the outer ply material in this strip adjacent the trailing edge 38 will remain adhered to the inner ply 16 after the panel portion 22 is stripped off. Delamination between the plies 18 and 16, and between the fibers of ply 18 is terminated by the continuous cut 38, the latter of which need only penetrate to the depth of which the material of the outer ply 18 is parted.

In summation, from the foregoing it becomes readily apparent to one skilled in the art that the present invention provides a merchandising container or packaging media incorporating, in a novel manner, a panel portion or iron-on including a heat transferable image imprinted thereon, which is integrally constructed with the outer wall or ply of a laminated container structure, and which may be easily detached or peeled off by the consumer for use of the iron-on on a transfer substrate without in any manner adversely affecting or destroying the integrity of the container, or necessitating the use of specialized tools.

Moreover, although the inventive container structure has been described in connection with a generally rectangular peelable panel portion having the transferable image imprinted thereon, other configurations and shapes for the peelable panel portion or so-called "iron-on" readily suggest themselves to one skilled in the technology. Thus, for example, it is also possible to contemplate shapes such as circles, ovals, octagons, hexagons and the like, the claims not being limited to the specific configuration illustrated herein.

What is claimed is:

1. A laminated container structure comprising on inner wall constituted of a substantially rigid material; an outer wall of a generally pliant material adapted to have indicia imprinted on at least the outer surface thereof; adhesive means extending intermediate said inner and outer walls for adhesively fastening said walls to each other; perforations extending through at least said pliant outer wall in a predetermined tear outline defining a removable panel section; a heat transferable image provided on said panel section; adhesive-repellent means provided intermediate the inner surface of said outer wall and said adhesive means substantially coextensive with the area of said removable panel section to prevent the latter from adhering to said inner wall and facilitate tearing off of said removable section along said tear outline without adversely affecting the integrity of said container structure, and a protective coating applied on said panel section, said coating imparting scuff resistance to said heat transferable image.

2. A container structure as claimed in claim 1, said heat transferable image being printed on the outer surface of said outer wall within the area of said removable section.

3. A container structure as claimed in claim 1 or 2, said heat transferable image being constituted of a heat transferable substance selected from the group consisting of sublimation dyes, disperse dyes, pigmented sublimation inks, or vinyl plastisol films.

4. A container structure as claimed in claim 1, said coating being permeable to the hot transfer of said heat transferable image.

5. A container structure as claimed in claim 1, said adhesive-repellent means being provided on the surface of said outer wall in contact with said adhesive means.

6. A container structure as claimed in claim 1, said perforations defining a generally rectangular removable outer wall section and including one continuous slit tear line along a first tear edge; discontinuous slits extending substantially perpendicularly and in parallel from each end of said continuous slit tear line so as to form the second and third tear edges of said removable section; discontinuous elongate slits extending towards each other from the free ends of said first-mentioned discontinuous slits in an outwardly tapered overlapping end relationship; and an outwardly curved slit forming a peelable pull tab for said removable section centrally interconnected with said overlapping slits.

7. A container structure as claimed in claim 1, said inner wall being formed of paperboard and said outer wall being formed of a thin pliable glossy finished paper.

8. A container structure as claimed in claim 1, said structure comprising a generally rectangular box-like container, said removable section being located on one exterior surface portion of said container.

9. A laminated container structure comprising an inner wall constituted of a substantially rigid material; an outer wall of a generally pliant fibrous material adapted to have indicia imprinted on at least the outer surface thereof; adhesive means disposed between said inner and outer wall for laminating said walls to each other; a series of slits perforating at least said pliant outer wall and extending in a predetermined tear outline defining a removable panel section adapted to contain at least a portion of said printed indicia, said tear outline being generally rectangular and including a continuous straight line slit defining the trailing edge of said removable panel section, discontinuous slits extending substantially perpendicularly to and in parallel from each end of said continuous slit to define the side edges of said removable panel section, and a series of discontinuous slits connecting the extended ends of said side edge slits and defining the leading edge of said removable panel section; adhesive repellent means disposed between the inner surface of said outer wall and said adhesive means in a coating substantially coextensive with the area of said removable panel section to faciliting peeling off said panel section along said tear outline, the pattern of said coating being offset from said trailing edge to define an uncoated border strip area at said trailing edge, whereby final separation of said panel section from said carton results from failure of the tensile bond between the fibers in the material of said section, which separation is completed along a straight line by said continuous cut to provide the removed panel section with a straight line trailing edge.

10. The invention according to claim 9, wherein the coating pattern of said adhesive repellent means extends outwardly at least to the side edges of said removable panel section.

11. The invention according to claim 10, wherein the coating pattern of said adhesive repellent means extends outwardly at least to the leading edge of said removable panel section.

* * * * *